United States Patent [19]

Intini, Jr.

[11] Patent Number: 4,524,513

[45] Date of Patent: Jun. 25, 1985

[54] FLAT TIP SPOON

[76] Inventor: Anthony V. Intini, Jr., 3468 Whirlaway Dr., Northbrook, Ill. 60062

[21] Appl. No.: 485,403

[22] Filed: Apr. 15, 1983

[51] Int. Cl.[3] ..... A47J 43/28

[52] U.S. Cl. ..... 30/149

[58] Field of Search ..... 30/141, 149, 150, 324, 30/327, 124

[56] References Cited

U.S. PATENT DOCUMENTS

| | | | |
|---|---|---|---|
| 631,713 | 8/1899 | Goodwin | 30/149 |
| 2,012,637 | 8/1935 | Ribley | 30/327 |
| 2,201,566 | 5/1940 | Voelker | 30/150 |
| 2,231,402 | 2/1941 | Whitman | 30/327 |
| 2,251,842 | 8/1941 | Hill | 30/149 |
| 2,674,793 | 4/1954 | Dominick | 30/150 |

FOREIGN PATENT DOCUMENTS

| | | | |
|---|---|---|---|
| 723233 | 4/1932 | France | 30/150 |

*Primary Examiner*—Paul A. Bell
*Assistant Examiner*—Paul M. Heyrana, Sr.

[57] ABSTRACT

A flatware or culinary spoon has a bowl with a rearwardly extending handle and a forwardly extending flat tip end area portion. The remainder of the bowl merges with the flat tip end area portion and provides a receptacle for material directed thereinto by the flat tip end area portion. Convexly arcuate side edges of the bowl merge with and terminate a substantial distance rearwardly from the forward portion of the flat tip end area portion, so that the sides of the flat tip portion forwardly from the side edges are free from interference from the forward ends of the side edges. The front edge of the flat tip end area portion may be convexly curvate, straight edge, indented or multi-lobed.

14 Claims, 9 Drawing Figures

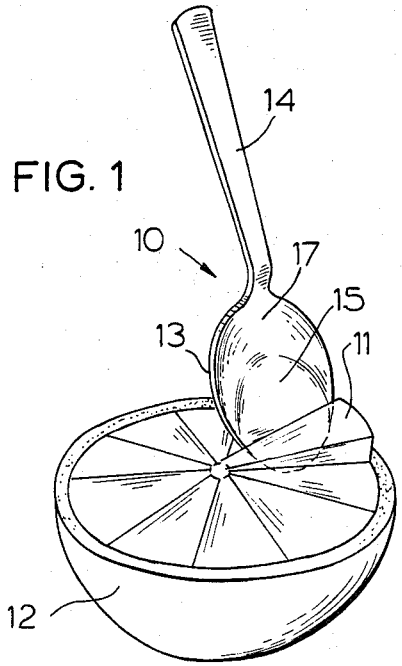
FIG. 1
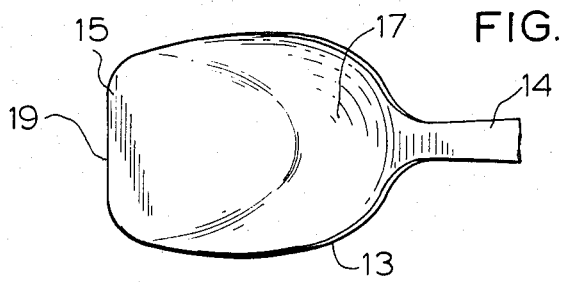
FIG. 7
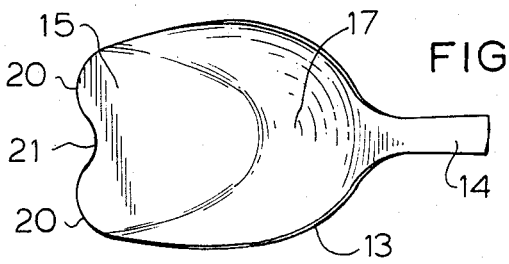
FIG. 8
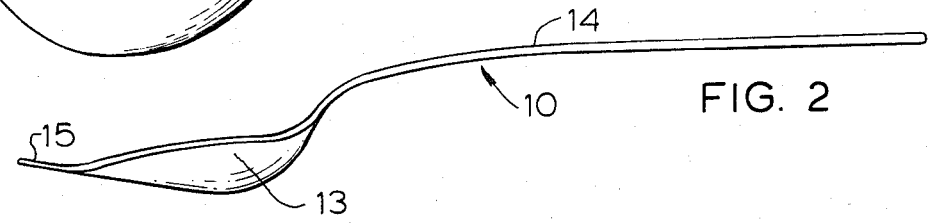
FIG. 2
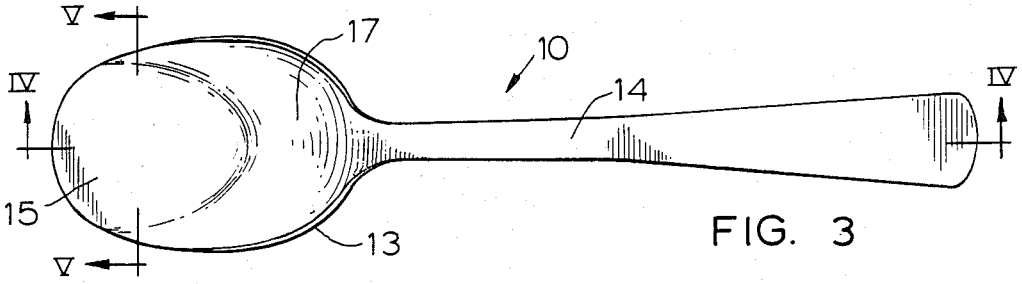
FIG. 3
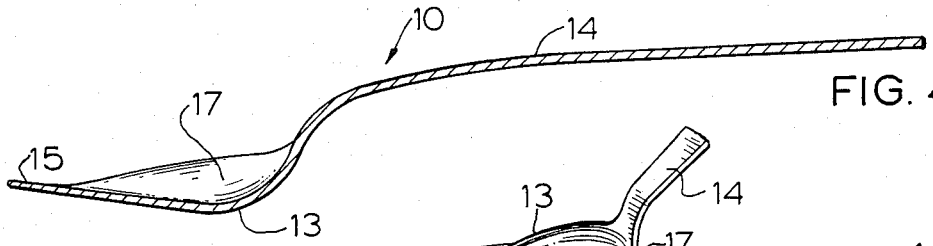
FIG. 4
FIG. 5
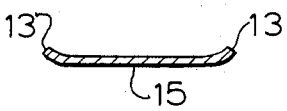
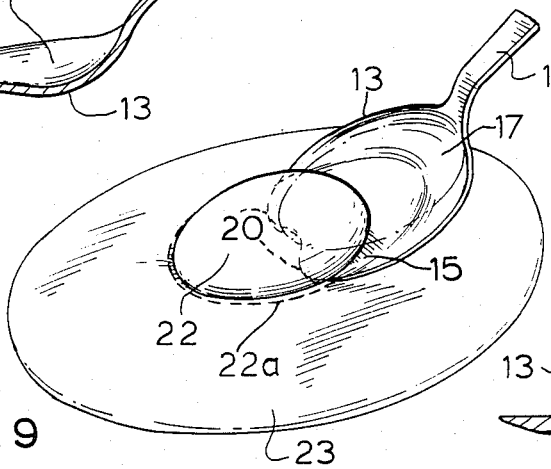
FIG. 9
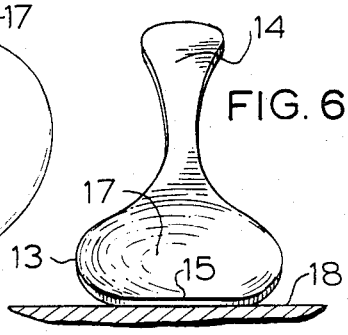
FIG. 6

FLAT TIP SPOON

This invention relates to improvements in flatware and culinary spoons and is more particularly concerned with novel spoons of this type having flat front tip end portions.

As heretofore constructed, the bowls of spoons have been concave, including the generally pointed tip end portions of the bowls. For numerous purposes the concave tip shape has imposed a considerable inconvenience. For example, for removing the edible sections from a half grapefruit it has been customary to loosen the sections from the membranes with a knife preliminary to removing the sections with a conventional spoon or even with a grapefruit spoon. Due to the conventional spoon curvature when digging into unloosened grapefruit sections, it is almost impossible to avoid rupturing some of the cells and causing a wild squirting effect.

Some consumers of fried eggs prefer to remove the more or less soft, unsolidified yolk from the congealed white. This is extremely difficult to accomplish with a conventional spoon of whatever size, without puncturing and spilling the yolk.

Spooning of some discrete edibles is difficult to perform efficiently with conventional spoons. Spoon scraping of some utensils presents problems.

It is therefore a principal object of the present invention to provide a new and improved flatware or culinary spoon structure which will enable spooning manuevers difficult or inconvenient to perform with a conventional spoon.

To this end, the present invention provides in a flatware or culinary spoon having a bowl with a front tip end portion and a rearwardly extending handle, the tip end portion being flat, and the remainder of the bowl merging with the flat tip end portion and providing a receptacle for material directed thereinto by means of the flat tip end portion.

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure and in which:

FIG. 1 is a perspective view showing a spoon embodying the present invention used for removing sections from a half grapefruit;

FIG. 2 is a side elevational view of the spoon;

FIG. 3 is a top plan view of the spoon;

FIG. 4 is a longitudinal sectional view taken substantially along the line IV—IV of FIG. 3;

FIG. 5 is a sectional detail view taken substantially along the line V—V of FIG. 3;

FIG. 6 is a front elevational view of the spoon demonstrating its use on a flat surface;

FIG. 7 is a fragmentary plan view of a spoon according to the present invention with a modified tip;

FIG. 8 is a view similar to FIG. 7 but showing another modification; and FIG. 9 is a perspective view demonstrating use of the spoon of FIG. 8 for removing the whole yolk from a freshly fried egg.

On reference to FIG. 1, a spoon 10 embodying the present invention is shown in use for removing a section 11 from a half grapefruit 12. To facilitate this manuever without first loosening the section 11 by means of a knife, the spoon 10 which has a bowl 13 and a rearwardly extending handle 14, is provided with a front tip end area portion 15 which is flat, at least in a transverse, that is from side-to-side direction. By virtue of the flat tip 15, the tip can be readily inserted to loosen the grapefruit sections 11 from the radial retaining membranes and the rind, virtually free from squirting, and then easily lifted out by the flat tip, and by such tip directed into the bowl of the spoon conveniently and efficiently.

As best visualized in FIGS. 2–6, the flat tip 15 may have a rounded edge of preferably relatively large radius of curvature whereby to provide a fairly broad receiving and lifting surface. Desirably also, the flat area of the tip portion 15 may extend to a distance inwardly along the bottom of the bowl 13. The remainder of the bowl merges with the tip portion 15, as shown, on generally concavely curvate contours, providing a receptacle 17 for material directed into the receptacle from the flat tip portion 15. The side edges of the bowl 13 are desirably convexly arcuate and merge with and terminate, as best seen in FIGS. 2–4, a substantial distance rearwardly from the forward portion of the flat tip end area or portion 15, so that the sides of the flat tip portion forwardly from the side edges of the bowl are free from interference from the forward ends of the side edges.

As best seen in FIG. 6, the flat tip area portion 15 enables flatwise engagement with a flat surface 18 which facilitates engaging under and picking up material from the flat surface. For example, such material may comprise food such as peas, corn and other discrete food products.

Instead of a rounded edge on the flat tip area 15 of the spoon, the edge may, as shown in FIG. 7, be a straight edge 19. Among other facilities, such a straight edge permits the spoon to serve efficiently as a scraper or spatula, with the bowl 13 facilitating picking up and handling scrapings.

By providing the flat tip area 15 with an indented, in this instance sinuously lobed, edge (FIG. 8) such as a pair of edge lobes 20 having a radius of curvature and separated by a concave indentation 21, certain uses are facilitated. For example as demonstrated in FIG. 9, the relatively broad lobe-edged flat tip area 15 of the spoon facilitates removal of a yolk 22 after it has been generally separated along a circumscribing line **22*a* from congealed white 23 of a fried egg. The tip area 15 efficiently engages the generally flat underside of the yolk and eases it into the bowl 17** as the spoon is pushed under the yolk.

From the foregoing it will be apparent that a new and improved flatware or culinary spoon structure has been provided wherein the flat tip area of the spoon greatly facilitates various desirable spooning manuevers where straight or flat or nearly flat surfaces are to be engaged, whether those surfaces are supporting surfaces or surfaces on food items. Thus, as pointed out grapefruit sections are more easily and efficiently separated from the half grapefruit segments. Egg yolks can be easily and efficiently removed from the congealed white of fried eggs without rupturing the yolks. Other food items and in particular discrete foods such as peas, corn and the like can be handled with greater facility. Spooning other cooked or fresh foods may be facilitated as well, such as cantaloupe, watermelon and the like. The spoon lends itself readily to use as a spatula or scraper with added facility of providing a bowl for handling scraping. Many other uses and spooning manuevers will be readily apparent to the user of the spoon. It will be evident that the principles of the invention are applicable to any desired size of flatware or culinary spoons such as the so-called baby spoon, teaspoon or grapefruit spoon sizes, serving spoon sizes and kitchen or cooking spoon sizes.

It will be understood that variations and modifications may be effected without departing from the spirit and scope of the novel concepts of this invention.

I claim as my invention:

1. In a flatware or culinary spoon having a bowl with a front tip end portion and a rearwardly extending handle:

said tip end portion being flat and having a forwardly extending planar front edge;

the remainder of said bowl merging with said flat tip end portion and providing a receptacle for material directed thereinto by means of said flat tip end portion; and said bowl having upturned sides with side edges thereof merging with and terminating a substantial distance rearwardly from the forwardly extending edge of the flat tip end portion, so that sides of the flat tip end portion forwardly from the side edges of the bowl are unobstructed by the side edges of said bowl.

2. A spoon according to claim 1, wherein said tip end portion has an edge on a radius of curvature.

3. A spoon according to claim 1, wherein said tip end portion has a straight edge.

4. A spoon according to claim 1, wherein said tip end portion has a multi-lobed edge.

5. A spoon according to claim 4, wherein said multi-lobed edge comprises a pair of lobes merging sinuously with an intermediate concave indentation.

6. A spoon according to claim 1, wherein said tip end portion is flat from side-to-side and also extends in flat plane to an extent inwardly along the bottom of the bowl and between said side edges.

7. A spoon according to claim 1, wherein said bowl is of generally concave convex shape with convexly arcuate side edges.

8. In a flatware or culinary spoon having a bowl with a front tip end area and a rearwardly extending handle:

said tip end area having a forwardly extending edge and being flat so that it is adapted to engage flatwise against straight or flat surfaces;

said bowl merging with said flat tip end area and providing an arcuately concave, curvate edges receptacle rearwardly adjacent to said flat tip end area for receiving material directed thereinto by means of said flat tip end area; and said bowl having side edges which merge with and terminate a substantial distance rearwardly from the forward portion of said flat tip end area, so that the sides of the flat tip portion forwardly from said side edges are unobstructed by the side edges of said bowl.

9. A spoon according to claim 8, wherein said forward portion of said flat tip end area is relatively blunt and of substantial width.

10. A spoon according to claim 8, wherein said forward portion of said flat tip end area has a convexly curvate front edge.

11. A spoon according to claim 8, wherein said forward portion of said flat tip end area has a straight front edge.

12. A spoon according to claim 8, wherein said forward portion of said flat tip end area has a multi-lobed front edge.

13. A spoon according to claim 8, wherein said forward portion of said edge is indented.

14. A spoon according to claim 8, wherein forward portion of said flat tip end area has an indented front edge.

* * * * *